US010228657B2

(12) United States Patent
Lagorgette et al.

(10) Patent No.: US 10,228,657 B2
(45) Date of Patent: Mar. 12, 2019

(54) DEVICE FOR SETTING WATCHES

(71) Applicant: ETA SA Manufacture Horlogere Suisse, Grenchen (CH)

(72) Inventors: Pascal Lagorgette, Bienne (CH); Raphael Balmer, Courrendlin (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 223 days.

(21) Appl. No.: 15/104,883

(22) PCT Filed: Dec. 12, 2014

(86) PCT No.: PCT/EP2014/077517
§ 371 (c)(1),
(2) Date: Jun. 15, 2016

(87) PCT Pub. No.: WO2015/091248
PCT Pub. Date: Jun. 25, 2015

(65) Prior Publication Data

US 2016/0320754 A1 Nov. 3, 2016

(30) Foreign Application Priority Data

Dec. 20, 2013 (EP) ..... 13199118

(51) Int. Cl.

| | |
|---|---|
| ***G04B 19/04*** | (2006.01) |
| ***G04B 47/00*** | (2006.01) |
| ***G04C 9/00*** | (2006.01) |
| ***G04G 5/04*** | (2006.01) |
| ***G04B 19/28*** | (2006.01) |
| ***G04B 27/08*** | (2006.01) |
| ***G04B 45/00*** | (2006.01) |

(52) U.S. Cl.
CPC ..... *G04B 47/003* (2013.01); *G04B 19/048* (2013.01); *G04B 19/28* (2013.01); *G04B 27/08* (2013.01); *G04B 45/0092* (2013.01); *G04C 9/00* (2013.01); *G04G 5/04* (2013.01)

(58) Field of Classification Search
CPC ..... G04B 19/28; G04B 19/22; G04B 47/003; G04B 19/048; G04B 27/08; G04B 45/0092; G04C 9/00; G04G 5/04
See application file for complete search history.

(56) References Cited

U.S. PATENT DOCUMENTS 3,316,709 A * 5/1967 Edwards ..... G04B 19/22 203/21
4,748,603 A * 5/1988 Ray ..... G04B 33/08 368/223
5,224,078 A 6/1993 Mallin
(Continued)

FOREIGN PATENT DOCUMENTS

CH 276769 A 7/1951

OTHER PUBLICATIONS

International Search Report dated Aug. 5, 2015 in PCT/EP2014/077517 filed on Dec. 12, 2014.

*Primary Examiner* — Sean Kayes
(74) *Attorney, Agent, or Firm* — Oblon, McClelland, Maier & Neustadt, L.L.P.

(57) ABSTRACT

A device for setting watches arranged to be pressed onto a crystal of a watch and including plural display mechanisms. The device is arranged to enable the user to see the display mechanisms of the watch as they are set.

21 Claims, 5 Drawing Sheets

(56) References Cited

U.S. PATENT DOCUMENTS

| | | | | |
|---|---|---|---|---|
| 5,375,102 | A | 12/1994 | Schiavolini | |
| 7,052,755 | B2 * | 5/2006 | Sasaki | G04B 19/103 428/202 |
| 7,742,360 | B1 * | 6/2010 | Price | G09F 11/23 116/308 |
| 8,770,832 | B1 * | 7/2014 | Kuo | G04B 19/283 368/21 |
| 2009/0185304 | A1 | 7/2009 | Harley, Jr. | |
| 2009/0190445 | A1 * | 7/2009 | Wilson | G04B 19/06 368/223 |
| 2011/0058457 | A1 | 3/2011 | Harley, Jr. | |

* cited by examiner

DEVICE FOR SETTING WATCHES

CROSS-REFERENCE TO RELATED APPLICATIONS

This is a National phase application in the United States of International patent application PCT/EP2014/077517 filed Dec. 12, 2014 which claims priority on European patent application 13199118.4 filed Dec. 20, 2013. The entire disclosures of the above patent applications are hereby incorporated herein by reference.

The present invention concerns the field of watch setting devices arranged to be pressed onto the crystal of a watch comprising several display means.

BACKGROUND OF THE INVENTION

There are known from the prior art watches or timepieces whose timepiece module can indicate the date, i.e. the day of the month, and can also indicate the month.

For the most common watches, the date indication is not optimum since it does not take account of the different number of days in each month of the year. Consequently, in the months of thirty days, the date has to be adjusted to advance the date by two notches, whereas in February, the date has to be advanced at least four or even five notches in the case of a leap year, to obtain the correct date.

Perpetual calendar modules have been created to overcome this problem. These timepiece modules propose to indicate the date while taking account of the different numbers of days in each month of the year depending on whether the year is an ordinary or leap year. Consequently, this timepiece module can change from one month to another without intervention by the user.

However, one drawback of these perpetual calendar modules is that they require a prior setting operation. The prior setting operation may take place during manufacture or on the first use or on each battery change. The setting operation consists in entering a setting mode and then setting the various parameters. These parameters are the date, the month and the year, i.e. the current level in the four-year cycle. This adjustment is far from straightforward, since it is not easy for the user or the watchmaker to define the current level in the cycle: is it currently a leap year or the year before or after a leap year This question is more complicated than expected and if, in addition, the setting steps are not clear, it soon becomes a chore for the user to set the perpetual calendar.

Further, this drawback is accentuated if, when the perpetual calendar is being set, there is no indication displayed as to what it is the user is setting. Indeed, if he does not know whether he is setting the day, the month or the year, the user is likely to give up.

SUMMARY OF THE INVENTION

It is one of the objects of the present invention to provide a setting device which overcomes the aforementioned drawbacks, that is to say by providing a setting device which is quick, clear and inexpensive to use.

To this end, the present invention consists of a device for setting watches arranged to be temporarily pressed onto the crystal of a watch comprising several display means, characterized in that said device is arranged to enable the user to see said display means of said watch during the setting of said watch, said device including at least one indexing mark for the angular indexing thereof with respect to a reference of said watch, and in that said device includes, for at least one particular display of said watch, at least one complementary piece of information relative to said particular display of said watch, to facilitate the setting of said particular display concerned.

In a first advantageous embodiment, said at least one complementary piece of information includes an indication of the nature of the particular display.

In a second advantageous embodiment, said at least one complementary piece of information includes a sequence displaying the entire possible setting range of said display means concerned.

In a third advantageous embodiment, the device includes at least one transparent plastic film.

In a fourth advantageous embodiment, the device includes several plastic films placed one atop the other each corresponding to at least one particular display of said watch.

In a fifth advantageous embodiment, the plastic films placed one atop the other are joined to each other by at least one join point, each film further including a gripping tab.

In a sixth advantageous embodiment, the device includes an annular part including at least one radially extending bar delimiting at least one area for a complementary piece of information.

In a seventh advantageous embodiment, said annular part and said at least one bar include several thickness levels each corresponding to one or more displays of said watch.

In another advantageous embodiment, said annular part includes a layer of adhesive material on the contact surface with the watch crystal.

In another advantageous embodiment, the device includes a plurality of transparent areas enabling the user to see said display means of said watch as they are being set.

In another advantageous embodiment, the device includes a plurality of areas provided with apertures enabling the user to see said display means of said watch as they are being set.

In another advantageous embodiment, said at least one particular display is a perpetual calendar parameter.

The invention also concerns a timepiece assembly including a mechanical and/or electronic timepiece movement and a setting device according to any of the preceding claims, characterized in that said timepiece movement is capable of operating in a setting mode in which the display means and at least one complementary piece of information of a particular display cooperate together to facilitate the setting of said at least one particular display concerned.

In a variant of this timepiece assembly, the display means include a central hour hand, a central minute hand and a small seconds hand on a counter at 6 o'clock for the display of the current time, and, for the display of the chronograph function, a central seconds hand and counter hands, the display means further including a disc disposed underneath an aperture for the date display.

In a variant of this timepiece assembly, the particular watch display set using the display means and the complementary information of the setting device is the perpetual calendar.

In a variant of this timepiece assembly, the particular watch display set using the display means and the complementary information of the setting device is different from the information displayed by said display means when the watch is in normal mode.

In a variant of this timepiece assembly, the display means cooperate in succession with the complementary pieces of information to set the particular display associated with each complementary piece of information.

The invention also concerns a method for setting a timepiece assembly comprising a timepiece movement and a setting device, said timepiece movement including control means comprising main and secondary control members and display means for displaying information, said setting device being arranged to be pressed onto a watch crystal to enable the user to see said display means of said watch as they are set, said device including at least one indexing mark for the angular indexing thereof with respect to a reference of said watch, and additionally, for at least one particular display of said watch, at least one complementary piece of information relative to said particular display, characterized in that the method consists in:

a) pressing said setting device onto the watch crystal;

b) activating the main control member to place the timepiece module in a setting operation mode in which the parameter setting phases are effected in an iterative manner, each phase comprising the following three steps:

displaying the parameter set during said phase by a movement of the display means;

selecting the value of the parameter by means of secondary control members;

validating the parameter value by acting on the main control member.

c) exiting the setting operation mode when the parameter value of the last phase has been effected and entering normal operation mode.

In a first variant of this method, validating the parameter value by acting on the main control member automatically results in a change to the next phase and automatically ends the setting step after the last parameter setting phase.

In a second variant of the method, the set parameter display step consists in moving the display means used to scan at least part of the range of selectable values for said parameter and to go to a position representing the first possible value for said parameter being set.

In another variant of this method, the set parameter display step consists in using a first display member to indicate the nature of the parameter to be set and in moving a second display member to scan at least part of the range of selectable values for said parameter and to go to a position representing the first possible value for said set parameter.

In another variant of this method, the first display member is one of the counter hands for indicating the nature of the parameter to be set, the second display member is a central hand.

In another variant of the method, the set parameter display step consists in moving the display means used to a position representing the first possible value for said parameter.

In a fourth variant of the method, in step b), each complementary piece of information cooperates with a distinct display means.

BRIEF DESCRIPTION OF THE DRAWINGS

The objects, advantages and features of the device according to the present invention will appear more clearly in the following detailed description of at least one embodiment of the invention, given solely by way of non-limiting example and illustrated by the annexed drawings, in which.

DETAILED DESCRIPTION

Figure 2:
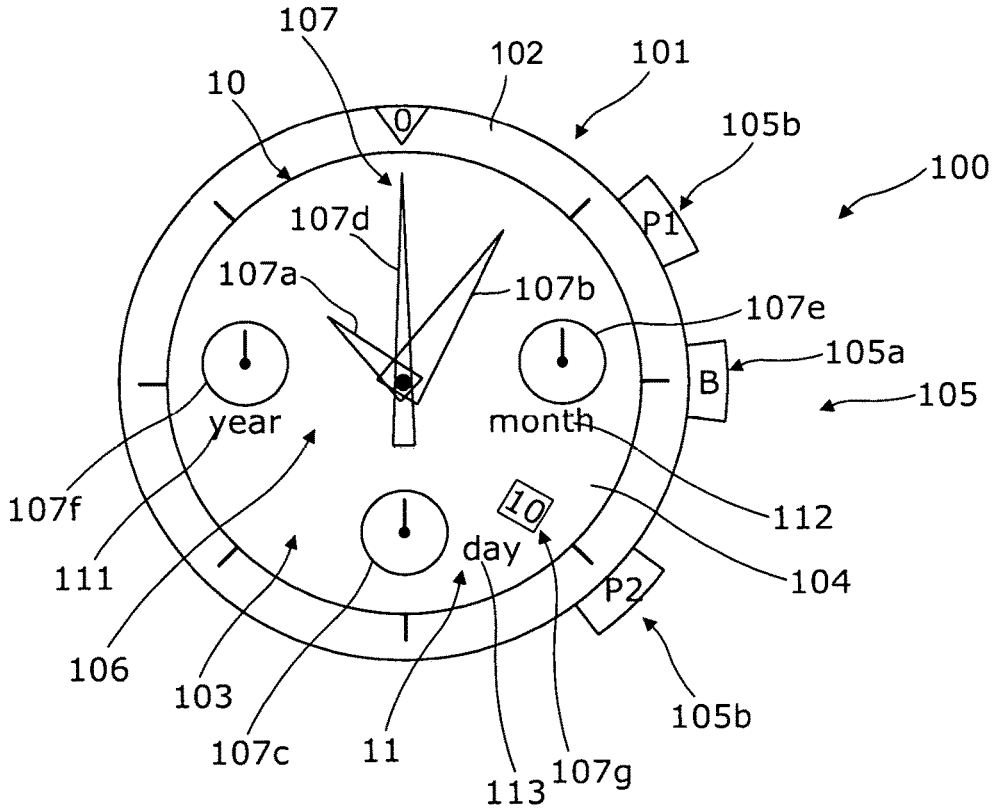
FIG. 2 is a schematic view of an assembly of a setting device assembly according to a first embodiment—watch according to a first embodiment of the invention.

FIG. 2 shows a watch 100 according to the present invention. This watch or timepiece 100 includes a case 101 in which is arranged a timepiece movement or module 100*a* (shown in FIG. 8). Case 101 includes a crystal 103 and a bezel 102. This timepiece module has a calendar function and more specifically a perpetual calendar function. This means that the timepiece module proposes to indicate the date taking account of the difference in the number of days of the months of the year and leap years.

The watch further includes control means 105. These control means 105 include a crown B able to be rotated and pulled into several positions, a first push-piece P1 and a second push-piece P2. Crown B is considered to be a main control member 105*a*, while push-pieces P1 and P2 are considered to be secondary control members 105*b*.

In a normal operating mode, this timepiece module sends time information to display means 106, which are associated with a dial 104 to indicate the information to the user. These display means 106 include at least one display member 107. Display member 107 may take the form of hands or discs disposed under an aperture in the dial. The time information is the current time, date and/or information relating to a chronograph function.

In the case of a chronograph watch, the display means 106 include central hands and counters each including a hand. Display means 106 are generally arranged to include a central hour hand 107*a*, a central minute hand 107*b* and a small seconds hand 107*c* on a counter at 6 o'clock for the display of the current time. For the display of the chronograph function, the central seconds hand 107*d* and the hands of counters 107*e*, 107*f* located at 3 o'clock and 9 o'clock are used. Display means 106 also include a disc disposed under an aperture 107*g* for the date display.

In a normal operation mode, the display means 106 display the current time and are used on demand for the chronograph function.

This timepiece module is capable of changing into a setting operation mode in which the perpetual calendar function is set. This setting consists in setting the date, i.e. the day, month and year, so that the timepiece module knows when the leap year occurs.

Advantageously according to the invention, this step of setting the perpetual calendar function is performed with the aid of the setting device 10. This setting device 10 is an element pressed onto the crystal 103 of watch 100. Setting device 10 includes a plurality of transparent areas 15 or apertures enabling the user to see said display means of said watch as they are being set.

This setting device also includes at least one complementary piece of information 11. Complementary piece of information 11 is used in cooperation with at least one display member 107 of display means 106 to facilitate the setting of a parameter. For setting a perpetual calendar, at least three complementary pieces of information 11 must be represented: one for the date, one for the month and one for the year.

Figure 1:
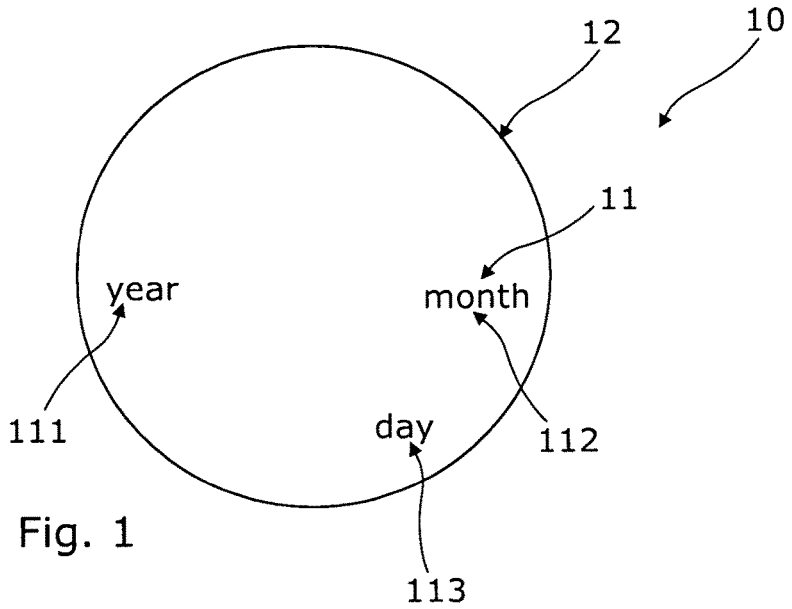
FIGS. 1 and 3 are schematic views of a setting device according to a first embodiment of the invention.

In a first embodiment of the invention seen in FIG. 1, setting device 10 may take the form of a self-adhesive plastic film 12. Plastic film 12 includes screen prints which are the different pieces of information 11. This embodiment of the invention has the advantage of being simple to implement since a self-adhesive plastic film is already present on timepieces. This film is used to protect the crystal. A screen printing step must simply be added to obtain setting device 10 according to the invention.

This plastic film 12 has transparent areas 15 enabling the user to see said display means of said watch as they are being set. The film may be totally transparent or also include opaque areas, for example to improve the contrast of the screen prints.

Figure 4:
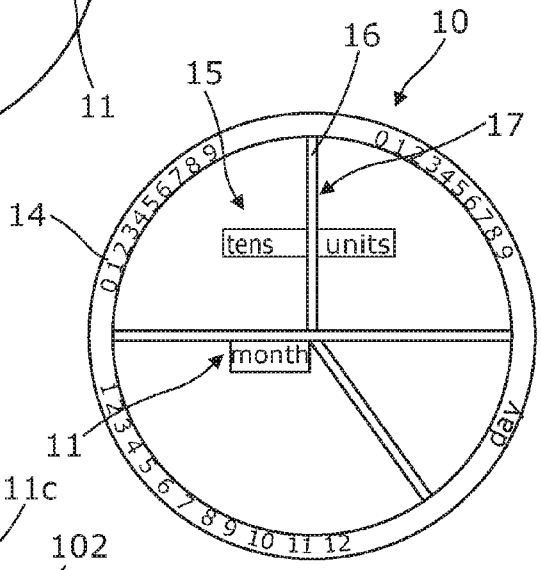
FIG. 4 shows a schematic view of a setting device according to a second embodiment of the invention.

In a second embodiment of the invention seen in FIG. 4, this setting device 10 may also take the form of a part 14, such as a three-dimensional frame. This part 14 includes transparent or pierced areas 15.

Part 14 takes the form of an annular part including several bars 16 to delimit the various areas, each area corresponding to a complementary piece of information 11. These areas 15 are solid and transparent or open to enable the user to see said display means of said watch as they are being set. These bars 16 extend on the diameter or radius of the annular part. Part 14 is preferably made of plastic and has a similar shape to that of dial 104 and/or of bezel 102 in order to be pressed onto crystal 103 and/or the bezel. This second embodiment has the advantage of being reusable, particularly in the event of further settings or a change of battery.

Setting device 10 further includes at least one indexing mark 17 for the angular indexing thereof with respect to a reference of said watch. In the case of the first embodiment, this indexing mark may be a screen print 18 to mark the 12 o'clock-6 o'clock axis, and or the 9 o'clock-3 o'clock axis, the screen print also serving to separate the areas for each complementary piece of information 13. The indexing may naturally also be achieved by the external parts of the watch (crown, push-piece, horns of the case middle . . . ), without hindering access to the push-pieces and the crown.

In the case of the second embodiment, the indexing mark 17 may be the actual structure of said part. Indeed, as seen in FIG. 4, bars 16 are arranged on the 12 o'clock-6 o'clock axis and/or the 9 o'clock-3 o'clock axis to serve as indexing marks.

When the setting device is used, a first step a) consists in arranging for setting device 10 to be pressed onto the watch crystal or clipped onto the watch case. Setting device 10 may be pressed on by the user or already present.

In a second step b), a press on main control member 105*a*, i.e. crown B, changes the mode from normal operation mode to setting mode.

In the setting step, the setting parameters of the perpetual calendar function are set in sequence so that for each parameter set, at least one display member 107 of display means 106 cooperates with one of the complementary pieces of information 11 of setting device 10.

Figure 6:
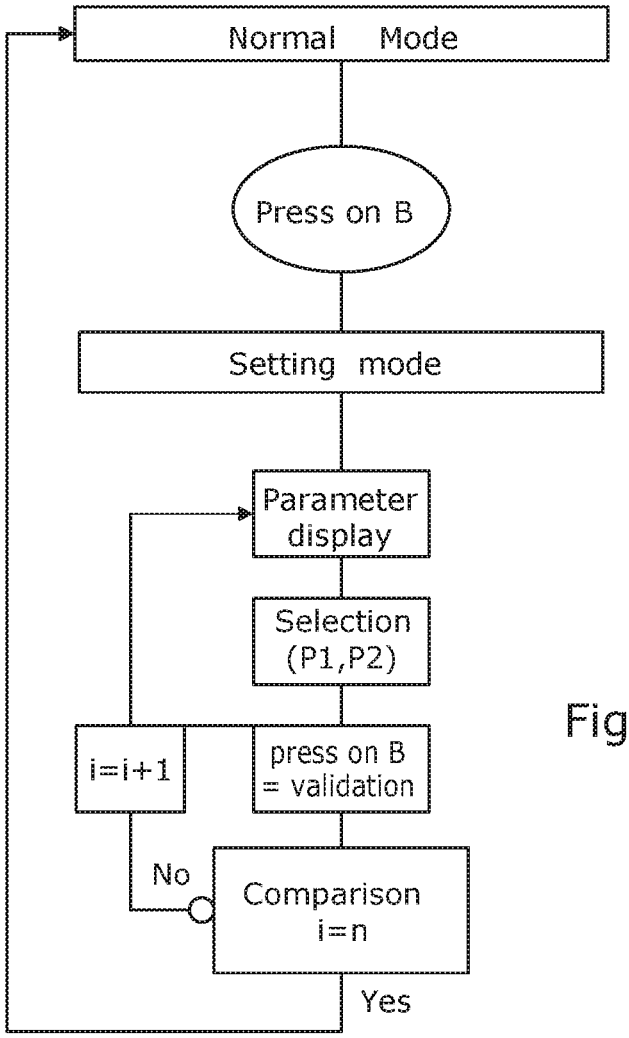
FIG. 6 is a schematic view of the setting method according to the invention.

The method seen in FIG. 6 consists, for each parameter i, in:

displaying the parameter i set during said phase by a movement of display means 106;

selecting, with the aid of secondary control members P1, P2, the value of the parameter, the display means moving accordingly;

validating the parameter value by acting on main control member B.

If for parameter i, i=n, then validating the value of parameter 1 by acting on main control member B makes it possible to start a step c) in which the watch exits the setting mode and enters normal operation mode, otherwise parameter i=i+1 is set.

According to a first embodiment of the invention seen in FIGS. 1 and 2, the complementary information is only used to specify to the user the parameter that is being set.

To achieve this, in a non-limiting example, three display members 107 are used. A first display member 107 and a second display member 107 each take the form of a hand cooperating with a graduated counter, such as counter 107*f* at 9 o'clock and counter 107*e* at 3 o'clock which are used for the chronograph function. The third display member 107 is a disc associated with an aperture 107*g* for the date display.

Upon entry into setting mode by action on control means 105, the timepiece module immediately enters a first phase in which a first parameter is set. For example, crown B will be used to enter the setting mode.

In this first phase, first display member 107*f* is used and a first complementary piece of information 111 is associated therewith. This first complementary piece of information 111 indicates the parameter that is being set. In the case of FIGS. 1 and 2, the first complementary piece of information 11 concerns the year and the first display member 107*f* is used. This first display member 107*f* makes a movement to indicate that the first parameter is being set.

The user must then indicate the current year with respect to the leap year. In this first phase, the timepiece module is thus programmed so that the first display member 107*f* only moves over four positions, each of the positions corresponding to a year in the leap year cycle. The user uses control means 105 to select the value of the first parameter and to validate the selection. Preferably, the first and second push-pieces P1 and P2 are used to increase or decrease the value of the parameter while crown B is used to validate the value, although these operations are non-limiting. Once validation is effected, the first phase is finished and a second phase is automatically started.

This second phase is for setting a second parameter. Second display member 107*e* is used and a second complementary piece of information 112 is associated therewith. This second complementary piece of information 112 concerns the current month. Second display member 107*e* makes a movement to indicate that the second parameter is being set.

In this second phase, the timepiece module is programmed so that the second display member 107*e* only moves over twelve positions, each of the positions corresponding to a month. The user uses control means 105 to select the value of the second parameter and to validate the selection. Once the selection is validated, the second phase is finished.

At that moment, a third phase, in which the third parameter is set, starts automatically. The third display member 107*g* is used and associated with a third complementary piece of information 113. This third complementary piece of information 113 concerns the date. Third display member 107*g* makes a movement to indicate that the third parameter is being set.

As third display member 107*g* is the current date aperture, the programming of the third display member 107*g* must not be changed. The user uses control means 105 to select the value of the third parameter and to validate the selection. Once the selection is validated, the third phase and the setting step are finished. Display means 106 therefore return to their initial or previous position.

The advantage of this first embodiment is that it uses the graduated counter hands at 9 o'clock and 3 o'clock used for the chronograph function and the date aperture. This does not disrupt the normal mode operation since the date aperture will be set to the correct date during the setting operation and it is chronograph display members 107 that are used and not current time display members 107.

The movement made by display members 107*f*, 107*e* and 107*g* may be a rotational motion of one or more steps before returning to zero.

Figure 3:
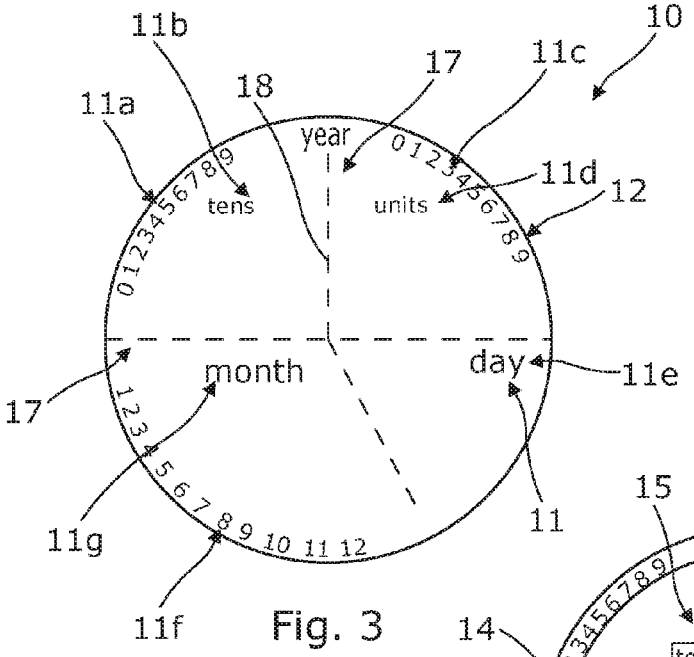
Figure 5:
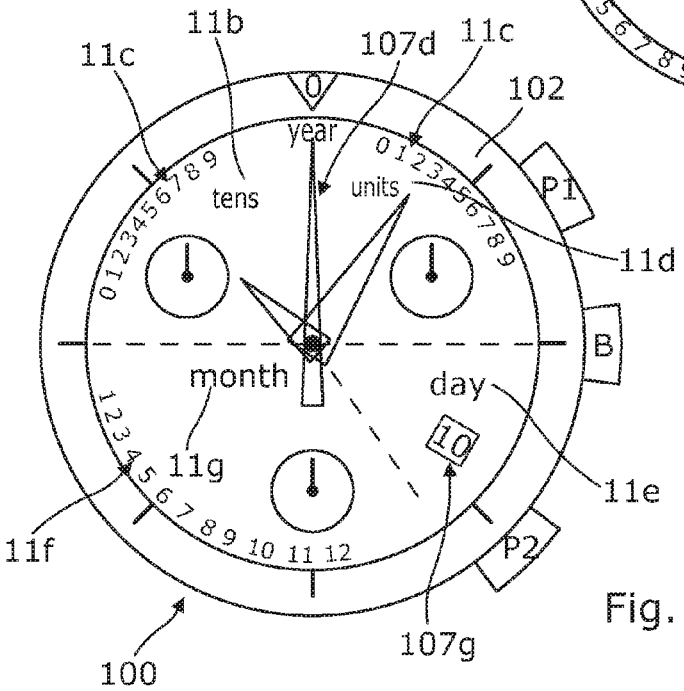
FIG. 5 shows a schematic view of an assembly of a setting device according to a first embodiment—watch according to a second embodiment.

In a second embodiment of the invention seen in FIGS. 3 to 5, complementary information 11 is used to specify to the user the parameter being set and/or to serve as a display sequence of the entire possible setting range for said display member concerned. This means that complementary information 11 is used as a scale when the various parameters are set.

In a non-limiting example, two display members 107 are used. A first display member 107 takes the form of the central seconds hand 107*d* used in normal operation mode for displaying the chronograph function. The second display member 107 is a disc associated with an aperture 107*g* for the date display.

Upon entry into setting mode, the timepiece module immediately enters a first phase in which a first parameter is set. In this first phase, first display member 107*d* is used and associated with a first complementary piece of information 11. This first complementary piece of information 11 includes the indication 11*b* of the parameter being set and the possible setting range 11*a* of said display member concerned for said parameter. First display member 107*d* moves to indicate that it is the first parameter being set.

In the case of FIG. 5, the first complementary piece of information concerns the year. The user must therefore indicate the tens number of the year concerned. Indeed, in this example embodiment, the object is to enter the current year. The current year is compared with a database incorporated in the timepiece module to determine whether it is a leap year and/or when the leap year will be.

In this first phase, the timepiece module is thus programmed so that the first display member 107*d* only moves over ten positions, from zero to nine. The user uses control means 105 to select the value of the first parameter and to validate the selection. As in the first embodiment, the first and second push-pieces P1 and P2 are used to increase or decrease the parameter value, while crown B is used to validate the value. Once validation is effected, the first phase is finished and a second phase is automatically started.

The second phase is for setting a second parameter. In this second phase, first display member 107*d* is used again and a second complementary piece of information is associated therewith. First display member 107*d* moves to indicate that it is the second parameter being set.

This second complementary piece of information also concerns the year and includes the indication 11*d* of the parameter being set, i.e. the year, and the possible setting range 11*c* of said display member concerned for said parameter. The user must therefore indicate the units number of the year concerned. The timepiece module is thus programmed so that the first display member only moves over ten positions, from zero to nine. The user uses control means 105 to select the value of the first parameter and to validate the selection.

Once validation is effected, the second phase is finished and the current year is complete and stored. For example, if, in the first phase the number nine is selected and in the second phase the number six is selected, this means that the current year is the year 2096. In fact, a date is pre-programmed in the watch so that such date is considered to be a reference. In another example, if, in the first phase the number one is selected and in the second phase the number four is selected, this means that the current year is the year 2014. At this moment, a third phase is automatically started. It is, however, possible to enter the entire date by entering the number two, then the number zero then the number one and then the number four to form 2014.

The third phase is for setting a third parameter. In this third phase, first display member 107*d* is used again and a third complementary piece of information 11 is associated therewith. This third complementary piece of information 11 concerns the current month and includes the indication 11*g* of the parameter being set, i.e. the month, and the possible setting range 11*f* for said parameter. First display member 107*d* moves to indicate that it is the third parameter being set.

The timepiece module is thus programmed so that first display member 107*d* only moves over twelve positions, from one to twelve. The user uses control means 105 to select the value of the third parameter and to validate the selection. Once the selection is validated, the third phase is finished.

A fourth step, in which a fourth parameter is set, starts automatically. In this fourth phase, second display member 107*g* is used and a fourth complementary piece of information is associated therewith. This fourth complementary piece of information is an indication 11*e* as to the current date. Second display member 107*g* is that normally used for the date display, and its operation is therefore not changed. Second display member 107*g* makes a movement to indicate that it is the fourth parameter that is being set.

The user uses control means 105 to select the value of the fourth parameter and to validate the selection. Once validation is effected, the fourth phase is finished and therewith the setting step.

The advantage of this second embodiment is that it uses the centre seconds hand 107*d* used for the chronograph function and the date aperture 107*g*. This does not disrupt the normal operation mode since the date apertuer 107*g* will be set to the correct date during the setting step and only one hand 107*d* relating to the chronograph function is used.

The movement made by display members 107*d*, 107*g* to indicate the parameter being set may be a rotational motion of one or more steps before returning to zero, or a scan of the possible setting range. Of course, any movement is possible.

Further, the order in which the various parameters are set is not fixed and they may be set in a different order. However, for pratical reasons, the first parameter and the second parameter are set one after the other. The parameters could be set in the order day-month-year or year-month-day or, depending on the position of the complementary information, clockwise or anticlockwise.

Figure 9:
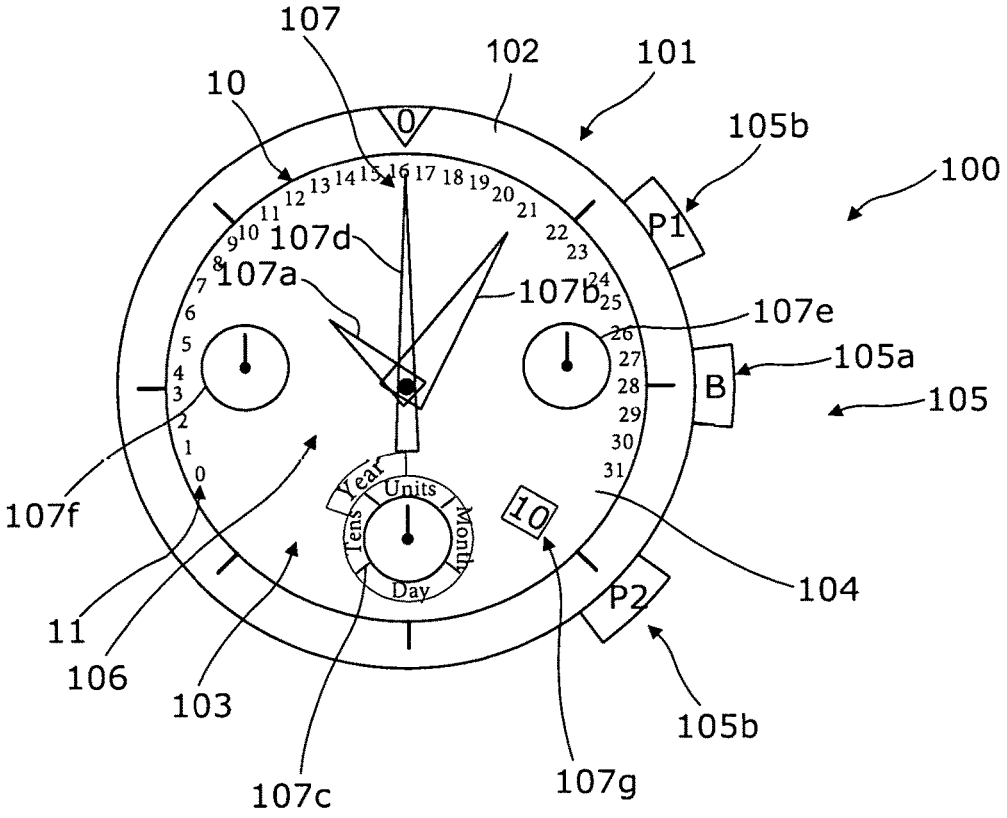
FIG. 9 shows a schematic view of an assembly of a setting device according to a first embodiment—watch according to a variant of the second embodiment.

In a variant of this embodiment seen in FIG. 9, the central seconds hand 107*d* is, for example, used to indicate the numbers selected in a sequence displaying the entire possible setting range. A counter 107*c* is thus used to indicate the current setting mode (1st digit of the year, 2nd digit of the year, month, day). Thus, film 12 or frame 14 includes information 11 around counter 107*c* and only numbers (from 0 to 12) for the centre hand. The numbers may be from 1 to 31 if the date is set in the same manner (seen in FIG. 9).

Figure 7:
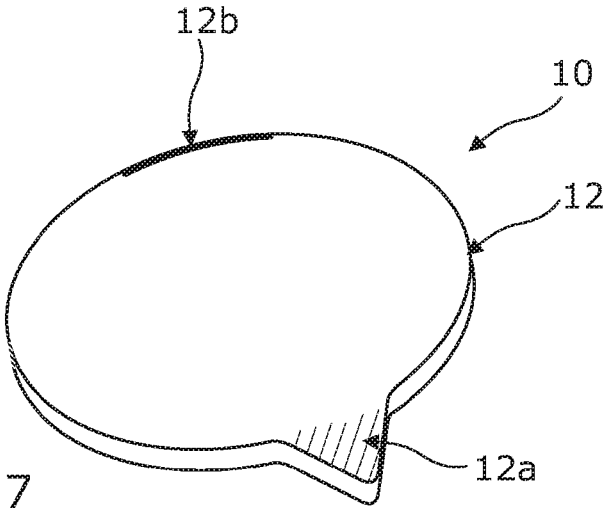
FIG. 7 is a schematic view of a variant of the setting device according to a first embodiment of the invention.

In a variant of the first embodiment of the invention seen in FIG. 7, setting device 10 is arranged to include several plastic films 12. These plastic films are connected to each other at at least one point 12*b* to form a leaflet type structure Each film 12 includes one complementary piece of information 11 so that when the setting associated with the complementary piece of information has been performed the film can be removed. This variant improves the visibility of the setting step since the number of settings still to be performed is immediately visible. To this end, each plastic film includes, preferably opposite the point of attachment of the films to each other, a non-stick tab 12*a* so that the user can easily remove the plastic films. More preferably, this tab is opaque so to be more visible.

In a first variant of the second embodiment of the invention, a layer 18 of adhesive material is arranged on the face of annular part 14 that rests on the watch crystal 103. This layer of adhesive material 18 makes it possible for the setting device to remain still during the setting step.

Figure 8:
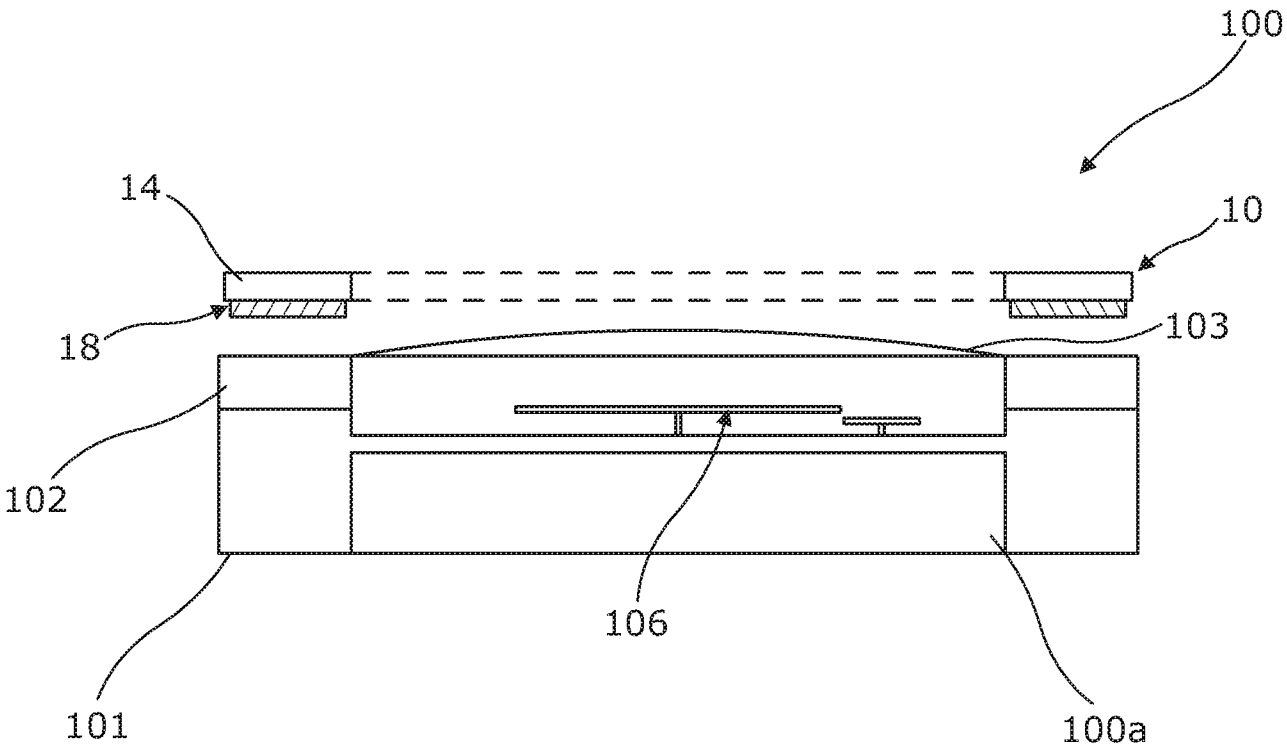
FIG. 8 is a schematic view of a variant of the setting device according to a second embodiment of the invention.

In a second variant of the second embodiment of the invention seen in FIG. 8, the pierced part is dimensioned such that annular part 14 is of a diameter equal to that of bezel 12. This feature results in annular part 14 resting on bezel 102 and not on crystal 103. This second variant may advantageously be combined with the first variant, i.e. by depositing a layer 18 of adhesive material on the face of annular part 14 resting on the watch.

In another non-limiting variant, the change into the setting mode is achieved by pulling on crown B. Entry into the setting mode occurs once crown B is completely pulled into a determined position.

Subsequently, the mode changes from one display mode to another, i.e. to set one parameter, then another, with P1, in a sequential manner. In each setting mode, the display is set by rotating the crown and the display is validated using P2.

To exit setting mode, the crown is returned to the rest position.

It will be clear that various alterations and/or improvements and/or combinations evident to those skilled in the art may be made to the various embodiments of the invention set out above without departing from the scope of the invention defined by the annexed claims.

Annular part 14 may be made to have several distinct thicknesses on each of which a complementary piece of information 11 is indicated.

The invention claimed is:

1. A device for setting watches arranged to be temporarily pressed onto a crystal of a watch comprising:

plural display means, wherein the device is arranged to enable a user to see the display means of the watch during setting of the watch;

the device further comprising:

at least one indexing mark for angular indexing thereof with respect to a reference of the watch;

for at least one particular display of the watch, at least one complementary piece of information relative to the particular display of the watch to facilitate the setting of the particular display concerned;

an annular part including at least one radially extending bar to delimit at least one area for a complementary piece of information; and a plurality of areas provided with apertures enabling the user to see the display means of the watch as the display means is being set.

2. The setting device according to claim 1, wherein the at least one complementary piece of information includes an indication as to a nature of the particular display.

3. The setting device according to claim 2, wherein the at least one complementary piece of information includes a display sequence of an entire possible setting range of the display means concerned.

4. The setting device according to claim 1, wherein the device includes at least one transparent plastic film.

5. The setting device according to claim 2, further comprising plural plastic films placed one atop each other corresponding to at least one particular display of the watch.

6. The setting device according to claim 5, wherein the plastic films placed one atop each other joined to each other at least one join point, each film further including a gripping tab.

7. The setting device according to claim 1, wherein the at least one complementary piece of information includes a display sequence of an entire possible setting range of the display means concerned.

8. The setting device according to claim 1, wherein the annular part and the at least one bar include plural thickness levels each corresponding to one or more displays of the watch.

9. The setting device according to claim 1, wherein the annular part includes a layer of adhesive material on a contact surface with the watch.

10. The setting device according to claim 1, wherein the annular part includes a layer of adhesive material on a contact surface with the watch.

11. The setting device according to claim 1, further comprising a plurality of transparent areas enabling the user to see the display means of the watch as the display means are being set.

12. The setting device according to claim 1, wherein the at least one particular display is a perpetual date parameter.

13. A timepiece assembly comprising a mechanical and/or electronic timepiece movement and a setting device according to claim 1, wherein the timepiece movement is capable of operating in a setting mode in which the display means and at least one complementary piece of information of a particular display cooperate with each other to facilitate setting of the at least one particular display concerned.

14. The timepiece assembly according to claim 13, wherein the display means cooperates in succession with the complementary pieces of information to set the particular display associated with each complementary piece of information.

15. The timepiece assembly according to claim 13, wherein the display means includes a central hour hand, a central minute hand, and a small seconds hand on a counter at 6 o'clock for a display of current time, and, for display of a chronograph function, a central seconds hand and counter hands, the display means further including a disc disposed underneath an aperture for the date display.

16. The timepiece assembly according to claim 15, wherein the particular display set using the display means and the complementary information of the setting device is a perpetual calendar.

17. The timepiece assembly according to claim 13, wherein the particular display set using the display means and the complementary information of the setting device is different from information displayed by the display means when the watch is in a normal mode.

18. A timepiece assembly comprising:

a mechanical and/or electronic timepiece movement; and a setting device for setting the timepiece assembly arranged to be temporarily pressed onto a crystal of the timepiece assembly, the device comprising:

plural display means, wherein the device is arranged to enable a user to see the display means of the timepiece assembly during setting of the timepiece assembly;

the device further comprising:

at least one indexing mark for angular indexing thereof with respect to a reference of the timepiece assembly; and for at least one particular display of the timepiece assembly, at least one complementary piece of information relative to the particular display of the timepiece assembly to facilitate the setting of the particular display concerned, wherein the timepiece movement is capable of operating in a setting mode in which the display means and at least one complementary piece of information of a particular display cooperate with each other to facilitate setting of the at least one particular display concerned wherein the display means includes a central hour hand, a central minute hand, and a small seconds hand on a counter at 6 o'clock for a display of current time, and, for display of a chronograph function, a central seconds hand and counter hands, the display means further including a disc disposed underneath an aperture for the date display.

19. The timepiece assembly according to claim 18, wherein the display means cooperates in succession with the complementary pieces of information to set the particular display associated with each complementary piece of information.

20. The timepiece assembly according to claim 18, wherein the particular display set using the display means and the complementary information of the setting device is a perpetual calendar.

21. The timepiece assembly according to claim 18, wherein the particular display set using the display means and the complementary information of the setting device is different from information displayed by the display means when the watch is in a normal mode.

* * * * *